United States Patent [19]

Thirtle

[11] 3,951,308

[45] Apr. 20, 1976

[54] APPARATUS FOR DISPENSING ADHESIVE MATERIAL

[75] Inventor: David Colin Thirtle, Camberley, England

[73] Assignee: Sale Tilney AG, Zug, Switzerland

[22] Filed: Nov. 11, 1974

[21] Appl. No.: 522,921

[30] Foreign Application Priority Data

Dec. 7, 1973 United Kingdom ..... 56870/73
Apr. 6, 1974 United Kingdom ..... 15475/74

[52] U.S. Cl. ..... 222/39; 215/DIG. 1; 220/246; 220/344; 222/146 HE

[51] Int. Cl.[2] ..... B67D 5/32; B67D 5/62

[58] Field of Search ..... 222/146 HE, 146 H, 146 R, 222/39; 220/346, 344; 215/DIG. 1

[56] References Cited

UNITED STATES PATENTS

| | | | |
|---|---|---|---|
| 3,298,572 | 1/1967 | Newton | 222/146 HE |
| 3,550,815 | 12/1970 | Salonen | 222/146 |
| 3,587,930 | 6/1971 | Schultz et al. | 222/146 HE |
| 3,764,045 | 10/1973 | Ornsteen | 222/146 HE |

FOREIGN PATENTS OR APPLICATIONS

| | | | |
|---|---|---|---|
| 168,846 | 10/1959 | Sweden | 220/344 |

*Primary Examiner*—Robert B. Reeves
*Assistant Examiner*—John P. Shannon
*Attorney, Agent, or Firm*—Larson, Taylor and Hinds

[57] ABSTRACT

The invention concerns apparatus, preferably a trigger-actuated portable gun, for dispensing adhesive comprising a housing containing a feed passage for receiving normally solid but heat-liquefiable adhesive block(s) having a flange for forming a fluid-tight yet yieldable seal with the feed passage, an outlet for liquefied adhesive, a coupling for connection to a source of pressurized fluid whereby in use fluid pressure is applied directly to the block(s) in the feed passage without the intermediation of a mechanical piston to advance the block(s) towards the outlet, and a heater for progressively liquefying the leading and of the block the remainder which serves as a piston for the liquefied portion thereof.

17 Claims, 10 Drawing Figures

APPARATUS FOR DISPENSING ADHESIVE MATERIAL

This invention concerns apparatus for dispensing adhesive material. Although it is not so restricted, it will hereinafter be particularly described with reference to a portable, manually operated dispensing gun for dispensing adhesive blocks described in co-pending British patent application Nos. 645/73, 1629/74 and 11337/74.

Preferred embodiments of our said co-pending applications describe adhesive blocks of thermoplastic material formed with at least one sealing flange so as to fit sealingly yet resiliently yieldingly into a dispensing passage of a dispensing apparatus and to permit the direct application of compressed air thereto.

One aim of this invention is to provide a relatively simple and inexpensive dispensing apparatus primarily, but not exclusively, for dispensing adhesive blocks of the above-mentioned kind.

Another aim of this invention is to seek to remedy certain important disadvantages of known portable dispensing guns.

The first important disadvantage of known dispensing guns operated by compressed air is that they employ a piston for advancing the adhesive block in the gun. The presence of the piston, however, makes the gun relatively large, heavy and introduces a moving component into the gun. Elimination of the piston would clearly enable a reduction in length, weight, complexity and cost to be obtained.

Another disadvantage of known guns resides in their arrangement to liquefy the normally-solid thermoplastic adhesive they employ. The usual adhesives are poor conductors of heat. Thus, to liquefy a part of an adhesive block rapidly, hitherto relatively large heat input has had to be used. Such input is, however, clearly wasteful due to the poor heat conductivity of the adhesive material and indeed most of the heat was dissipated in heating the walls of the feed passage or melting chamber, usually made of heat-conducting (metallic) material, rather than in liquefying the adhesive block. In other words, in these known guns the power consumption due to heating has been far in excess of that required merely to liquefy the adhesive.

A concomitant disadvantage of the excessive heat input has been the high temperature, in use, of a considerable portion of the exterior of gun which either renders the gun somewhat liable to cause burns to an operator, who may be relatively unskilled, or which requires the relevant parts of the gun to be cooled by artificial means.

Still further, hitherto known guns operated by compressed air required relatively large amounts of such air, partly to propel the piston and partly for cooling purposes. Known dispensing guns operated mechanically (e.g. by spring pressure) or manually (e.g. by finger pressure) to advance the thermoplastic block, on the other hand, either increased the complexity of the construction and thus also the liability to breakdown, or were uncomfortable to operate for the reasons already stated, or both. The drawbacks of large heat dissipation both as regards power consumption and safety remained with these guns also.

Yet other known dispensing guns have arrangements for loading the adhesive blocks into the gun, which are cumbersome, require both hands of the operator to be employed in the task and are "handed" e.g. are suited only to right-handed persons.

This invention seeks to eliminate or at least reduce the above-mentioned disadvantages and to provide a dispensing apparatus which is relatively inexpensive and simple to fabricate, and which is reliable, uncomplicated and comfortable to use.

According to one aspect of the invention, there is provided dispensing apparatus for dispensing adhesive material comprising;

a. housing;

b. a feed passage in the housing adapted to receive adhesive in the form of at least one normally substantially solid but heat-liquefiable block which has means adapted to form a fluid-tight yet yieldable seal with the feed passage, c. a discharge opening for liquefied adhesive communicating with the feed passage, d. coupling means for enabling the feed passage to be connected to a source of pressurized fluid so that in use fluid pressure is applied directly to a said block in the feed passage without the intermediation of a mechanical piston to advance the said block along the feed passage towards the discharge opening;

e. heating means for heating and progressively liquefying a said block of adhesive from its leading end, the solid portion of the said block serving, in use, as a piston for the liquefied portion thereof; and, preferably, f. valve means for controlling the flow of pressurized fluid from said source via the coupling means to the feed passage.

The term "block" is intended to include the case where the block is a one-piece member made of heat-liquefiable adhesive material which is solid at normal temperature and is either non-tacky or is rendered substantially non-tacky by the application of a suitable adhesion reducing agent e.g. a powder. It also includes the case where the block is made of heat-liquefiable adhesive material that is tacky and/or has poor shape retaining properties at room temperatures and hence is made in the form of a cartridge by having a heat-consumable, solid outer sleeve, liner or other mechanical support. A preferred embodiment of such blocks will be given below, but further examples may be found in our co-pending applications Nos. 645/73 and 1629/74 cognate 11337/74.

Preferably, said discharge opening is in a nozzle member attached to said housing, and the heating means is accommodated in the nozzle member.

The nozzle member may advantageously have an internal bore for communicating the feed passage with the discharge opening, there being a dispensing valve in said bore operable solely by hydraulic pressure of liquefied adhesive for permitting or preventing flow thereof to the discharge opening. This arrangement is in contrast to certain known dispensing devices wherein a functionally equivalent valve is externally controlled, e.g. by being mechanically linked to a trigger actuator.

Expediently, the heating means includes or is connected to, a heat-conductive member extending partly into and across the path of the block of adhesive to increase the rate of transfer of heat thereto. A preferred heat-conductive member is in the form of a ring of angled turbine blade-like projections, made of metal.

Alternatively, said heat-conductive member may a substantially cross-shaped member, a flat helix, or a star-shaped spider, made of aluminum or of a copper alloy. The criteria for choosing the configuration of the heat-conductive member may vary according to circumstances: the important thing, however, is to provide a large contact area between it and the adhesive block to be liquefied, across the full cross-section of the block. Thus, the embodiment with the ring of angled blades not only provides full transverse contact, but the angling of the flow path between adjacent blades causes that path to be lengthened and thus increases the heat transfer area, and it may impart swirl to the liquefied adhesive.

The nozzle member may include a readily removable and replaceable nozzle tip body in which said discharge opening is formed, the opening being of predetermined dimensions to assist in controlling the flow rate of molten adhesive, the said tip body constituting a member of a set of nozzle tip bodies of varying dimensions. Thus a correct choice of nozzle tip body can be made to suit the viscosity and other characteristics of the particular adhesive material to be used. The nozzle member may be of reduced outer diameter relative to that of the housing and the internal cross-section of the bore is smaller than that of the feed passage.

Preferred embodiments of the invention provide particularly simple arrangements for loading blocks, advantageously two blocks at a time, into the dispensing gun. In one example, the feed passage has an opening, preferably at its end remote from the end communicating with the nozzle member, through which opening said block(s) may be loaded into the feed passage, a cap displaceable to cover and uncover the opening, a latch for securing the cap in its position covering the opening, a deformable sealing member mounted as a loose fit in a recess between adjacent surfaces of the cap and the edges of the said opening, the arrangement being such that when the cap is closed and latched, introduction of pressurized fluid into the feed passage deforms the sealing member to make a fluid-tight seal between the cap and the said edges.

By placing the opening at the end and by arranging that the cap is in fact expediently pivotable about an axis transverse to the axis of the feed passage, "handed"-ness is eliminated. This is in contrast to certain known gun-type dispensers wherein the feed passage consists of two parts movable apart at a mid-section of the feed passage by pivotal displacement about a vertical axis which, in that known gun, results in a right-handed arrangement.

The particular arrangement of the loose-fitting sealing member is also advantageous in that tolerances in its mounting recess need not be as stringent as in functionally equivalent prior art parts which all employed O-rings.

In an alternative preferred embodiment, the coupling means includes a conduit for conveying pressurised fluid to one end of the feed passage, and a closure member for said one end which incorporates a part of said conduit and which is movable between a first position in which it uncovers said one end to permit a said block to be loaded into the feed passage and a second position in which it closes said one end and establishes communication between said conduit and the feed passage for the direct application of pressurized fluid to the block.

Preferably, the feed passage is defined by the interior of an elongated sleeve of heat-insulating and low-friction material. One example of such material is PTFE (polytetrafluoroethylene).

In an optional embodiment, a vent opening communicating with the atmosphere is provided at a position in the wall of the feed passage, such that where the feed passage can accommodate more than one block and in use the seal-forming means of the rearmost block has been consumed, further application of pressurized fluid will result in such fluid rushing through the vent opening to provide an operator with an aural warning. The operator will therefore stop further actuation of the gun and will reload it. The warning effect may be enhanced by shaping the opening to produce a whistling sound. Another advantage of the provision of the vent opening lies in that where more than one block is present in the feed passage, any air trapped between the seal-forming means of the blocks may in use be considerably pressurized. The vent opening allows this compression to be relieved.

Means may be provided for biasing the valve member for controlling flow of pressurized fluid into a flow-preventing setting, there being an actuator device for displacing the valve member to a flow-permitting setting. Thus normally the pressurized fluid is "off" and is only switched to the "on" position when it is desired to commence dispensing adhesive, thus providing economical consumption of the pressurized fluid. It may here be mentioned that while normally said fluid is compressed air provided by a line from a source, it is certainly envisaged that the source may in fact be a compressed air bottle, bulb or cartridge.

In one embodiment, the actuator device is a trigger mounted in a pistol-grip casing connected to the said housing and contains a displaceable, substantially spherical or part-spherical joint connected by way of a shank to the closure member of the feed passage, said conduit passing through the interior of the spherical or part-spherical member, the shank and the closure member.

The preferred heating means is a cartridge heater located in the nozzle member and extending parallel with or obliquely relative to the bore. The cartridge heater may also be located in the nozzle member and extending at right angles to the nozzle and through the bore. To control the heat input, the apparatus is preferably provided with a temperature sensing device located adjacent the heating means.

Preferred embodiments of the invention will now be described, by way of example only, with reference to the accompanying drawings, in which.

Figures 5, 10:
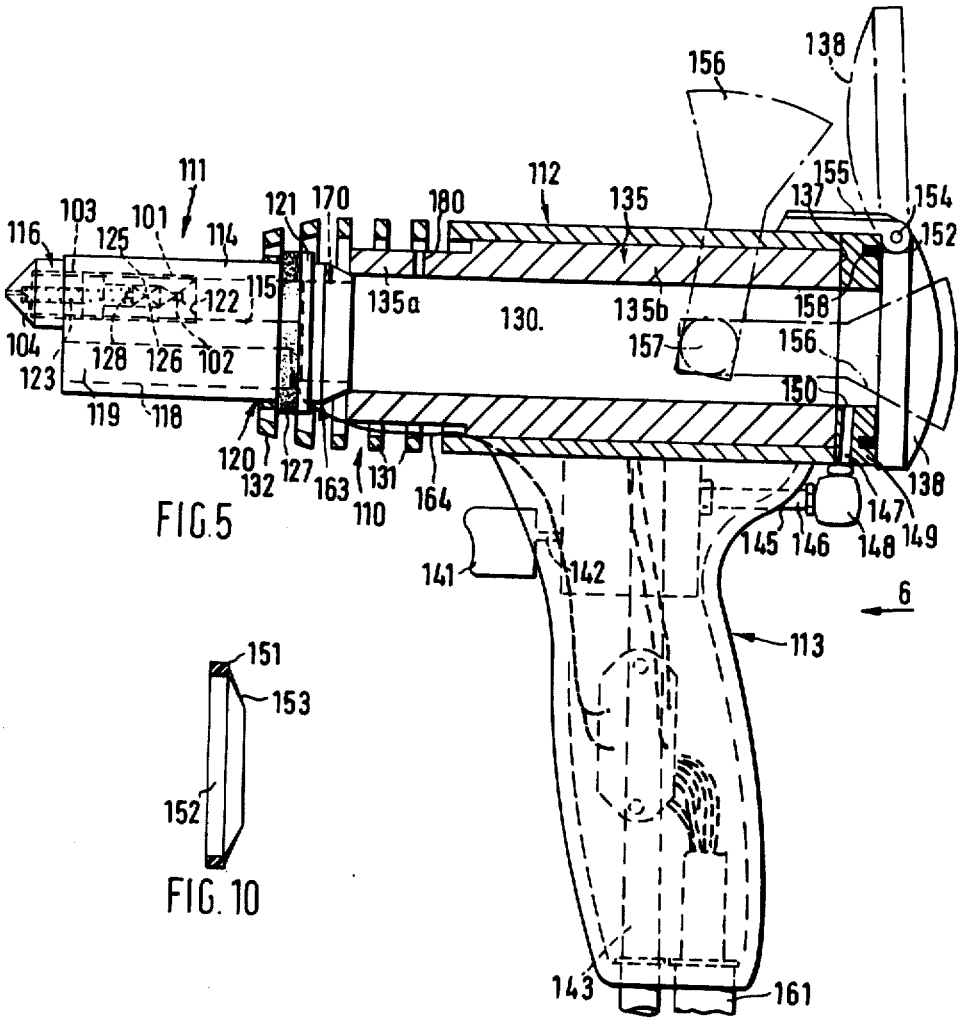
FIG. 5 is a schematic view, partly in elevation and partly in section, of a second embodiment of a portable, trigger-actuated adhesive dispenser gun according to the invention.
Figure 6:
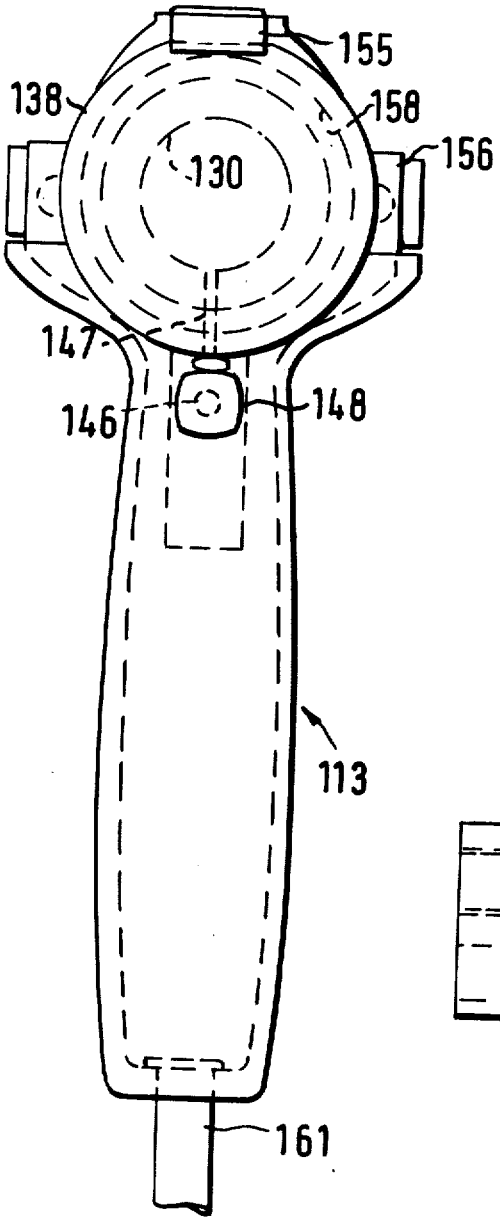
FIG. 6 is an elevational detail, taken along the arrow 6 in FIG. 5.
Figure 8:
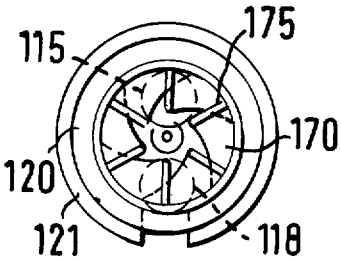
Figure 9:
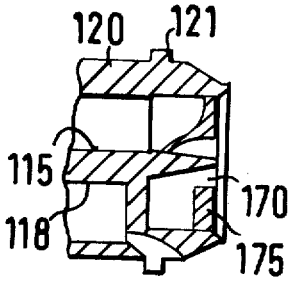
Figure 7:
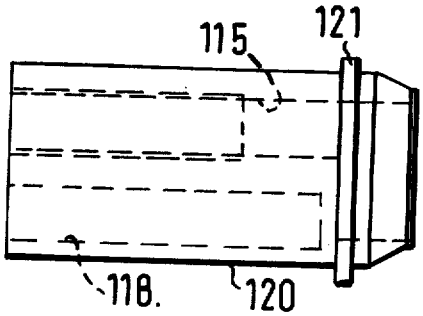

FIGS. 7 to 9, respectively in side elevation front elevation and fragmentary cross-section show details of the nozzle member and of the heat-conductive member that form part of the gun of FIG. 5, and FIG. 10 shows a gasket in section, for use with the loading device of the dispenser of FIG. 5.

Figures 1, 2:
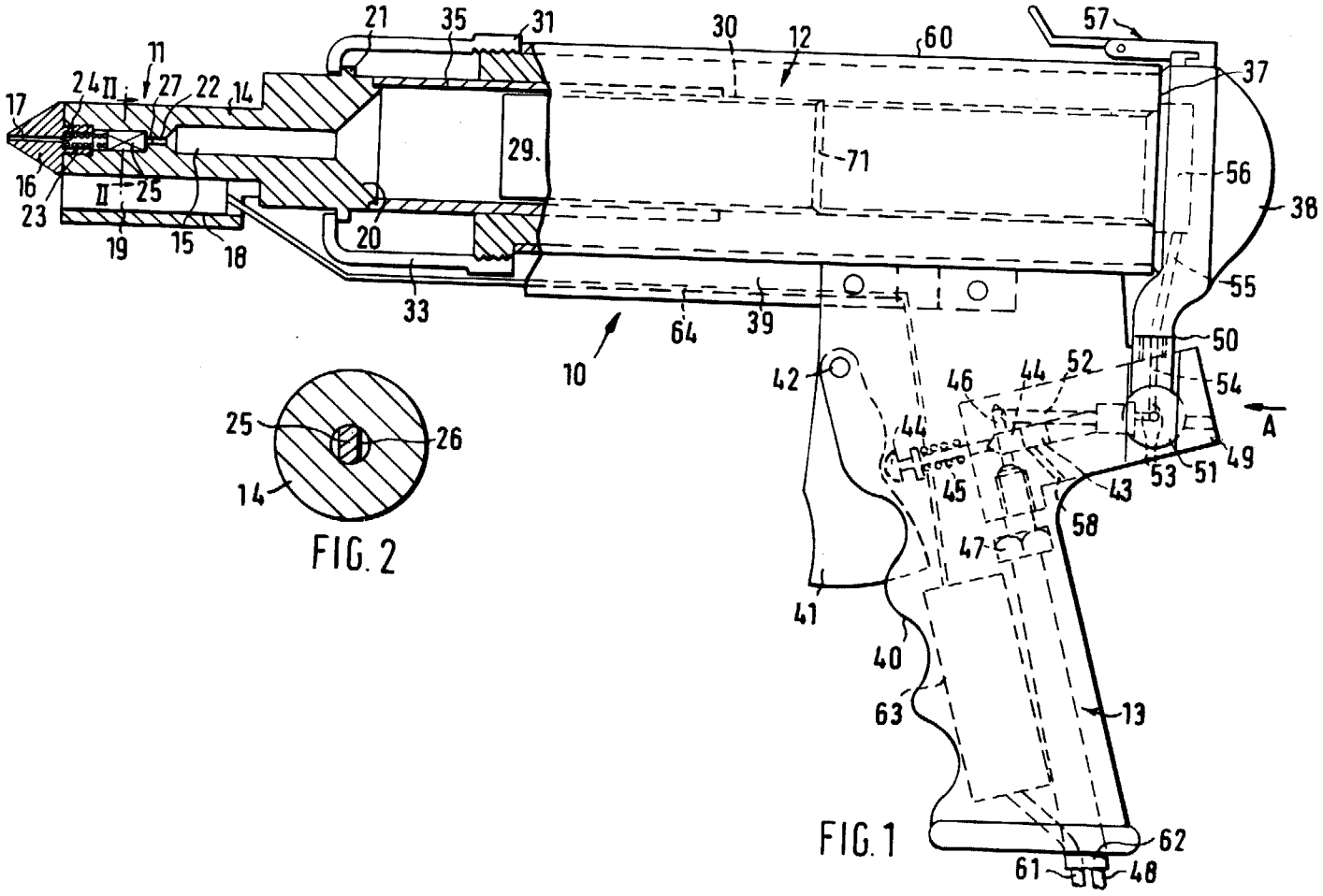
FIG. 1 is a schematic elevation, partially broken-away, of a portable, trigger-actuated adhesive dispenser gun according to a first embodiment of the invention.
FIG. 2 is a section taken along the line II—II of FIG. 1.
Figure 3:
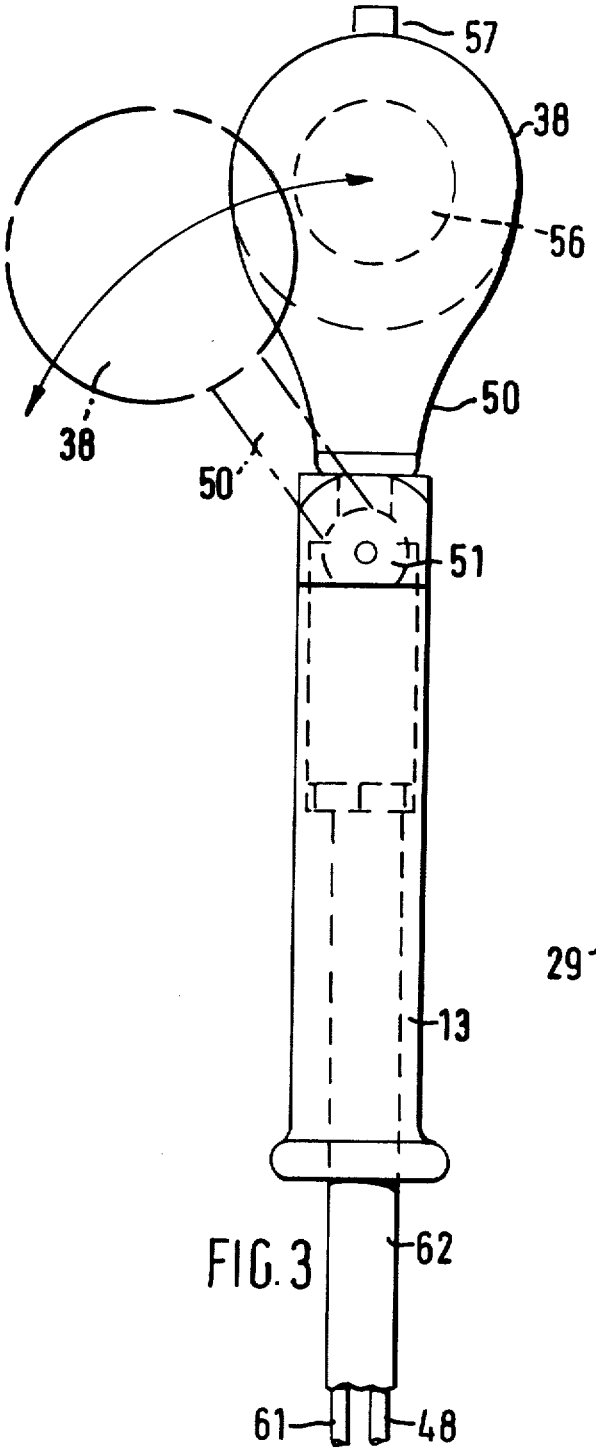
FIG. 3 is an elevational detail, taken along the arrow A in FIG. 1.

Referring first to FIGS. 1 to 3 of the drawings, there is shown a trigger-actuated, portable gun for dispensing heat-liquefiable adhesive which utilizes electric heating to liquefy an adhesive block that is solid (or substantially so) at room temperature, and which utilizes compressed air directly applied to the adhesive block to advance the latter within the gun, without the intermediation of a mechanical piston.

Various embodiments of adhesive members, blocks or cartridges have been disclosed in our said co-pending applications, which also disclose suitable materials, or mixtures of materials, for the adhesive. The dispensing gun of the present invention is capable of operating with all these, but one example is described below in conjunction with FIG. 4.

The gun is generally designated by 10 and comprises a nozzle unit 11, a housing or barrel 12, and a pistol-grip actuator casing 13.

The nozzle unit 11 includes a nozzle body 14 made e.g. of copper and formed with an internal bore 15 terminating in a screw-connected and thus readily removable and replaceable nozzle tip 16 having a discharge orifice 17 of predetermined dimensions. It is envisaged that a set of nozzle tips 16 with differently dimensioned orifices 17 could be cupplied with the gun, whereby to facilitate variation in control of the flow rates of molten adhesive.

Substantially parallel with and extending alongside of the bore 15 is another bore 18 which serves to accommodate an electric cartridge heater 19, typically a 60W, 240V heater.

The portion 20 of the nozzle body 14 is secured, by means described below, to the barrel 12. The portion 20 is of enlarged cross-section tapering towards the discharge orifice and has an integral annular flange 21 against which bear, on the nozzle tip side, the hooked ends of three substantially equiangularly spaced apart retaining arms 33 which extend from a common ring 31 screwed to the barrel.

About half-way along the length of the nozzle unit 11, the bore 15 is provided with a reduced section or constriction 22. One end of a spring 23 bears against a shoulder 24 in the part of the bore which is within the nozzle tip 16, while its other end bears against a valve member 25. A projection 27 on the valve member 25 is urged by the action of the spring 23 on the valve member 25 blocking engagement with the constriction 22. As shown in FIG. 2, the valve member 25 has flat sides 26 along which flow may take place after displacement of the valve member.

The barrel 12 is essentially a hollow cylinder e.g. of aluminium, within which an internal feed passage 30 is disposed for accommodating adhesive blocks to be advanced towards the nozzle unit 11 by the direct application of compressed air to the rear of such blocks. The length of the feed passage 30 and/or the length of each adhesive block 29 (FIG. 4) is so chosen that more than one block may be loaded at the same time into the feed passage.

The inside of the front end of the barrel 12 has an annular sleeve 35 of PTFE or other suitable low-friction and heat-insulating material secured to it. By virtue of being relatively near to the nozzle unit 11 which in use is heated, the sleeve 35 may also get quite hot. However, since it is made of a low-friction, heat-insulating material, when operation ceases, the portion of an adhesive block that may be located inside the sleeve 35 will not liquefy or even if it does, the liquid adhesive will not adhere to the wall thereof.

The rear or right-hand end 37 of the barrel 12 co-operates with a cap 38 in the manner described in more detail below. The barrel 12 has a depending web 39 to which the pistol grip actuator casing 13 is secured in any suitable manner, e.g. by rivets or bolts.

The casing 13 is hollow and its front edge 40 has a sinous contour to accommodate the fingers of an operator. A trigger 41 projects from the edge 40. The trigger 41 is pivotally secured in the housing at 42 and is engageable with a valve member 44 in the form of a shuttle which is movable in a drilling 43 under the bias of a spring 45 to its position shown in FIG. 1. The valve member 44 or shuttle can move across an air conduit or bore 46 to prevent or to permit air flow therethrough. The bore 46 extends downwardly in the casing 13 and is connected by a coupling 47 to a line 48 supplied in use with compressed air from a suitable source (not shown), which air is preferably filtered.

The rear edge of the casing 13 is formed with a spur 49 to which the cap 38 is connected by way of a shank 50 extending into the interior of the spur 49. The shank 50 terminates in a substantially spherical end or ball pivot 51 mounted in a recess of the spur for limited pivotal movement about a generally horizontal axis.

The bore 46 communicates with a further bore 52 which in turn communicates with bore 53 in the ball pivot 51, a bore 54 in the shank 50, and a bore 55 in the cap 38. The bore 55 communicates with a manifold 56 inside the cap 38. Thus, in operation, with the cap 38 lying against the feed passage 30 depression of the trigger 41 causes the shuttle to free the bore 46 for the flow of compressed air which can then flow along the bores 52, 53, 54 and 55 and through the manifold 56 to the feed passage 30.

A bleed aperture 58 is provided in the housing to allow compressed air to vent to the atmosphere when the gun is inoperative, this aperture being closed by the shuttle 44 on depression of the trigger 41.

The pivotal movement of the shank 50 and cap 38 is limited by suitably arranged abutments provided in the spur 49 to that, in the loading position, the cap 38 overlies the rear end 37 of the feed passage 30 in exact register and seals it. The said rear end 37 is preferably formed with an annular groove into which an O-ring gasket (not shown) is inserted. The cap 38 is formed with a quick-release latch arrangement 57 to lock the cap 38 in its FIG. 1 or operative to position and to allow it rapidly to be moved into the loading position shown in dotted lines in FIG. 3.

The whole of the gun 10 has an external housing 60 indicated in FIG. 1. The housing 60 is preferably perforated for access of ambient air for cooling and for lightness.

FIG. 1 also shows an electric supply line 61 enclosed in a sleeve 62 which also holds the air line 48. The line 61 is connected to a temperature control unit 63 disposed in the housing 13 and connected by a line 64 to the cartridge heater 19. The unit 63 contains a logic circuit for controlling the operation of the heater 19.

The operation of the gun described so far is as follows. It is assumed that the heater cartridge has been energized from an electrical power source, and the conduit 46 has been connected to a source of compressed air.

Figure 4:
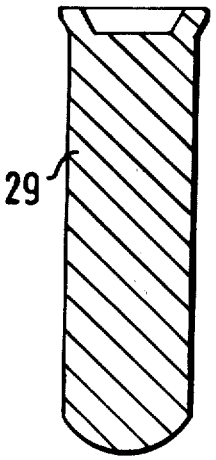
FIG. 4 is an elevation of an adhesive block for use in the dispenser of FIGS. 1 to 3.

First, the cap 38 is pivoted to its loading position, i.e. out of the plane of FIG. 1 and, say two adhesive blocks or cartridges, as described in said co-pending applications, or as shown at 29 in FIGS. 1 and 4, are introduced into the feed passage 30. The cap 38 is then re-closed. The gun 10 is now ready for use.

When the operator presses the trigger 41 against the biasing force of the spring 43, the shuttle 44 moves across the air conduit 46 to free the latter for the flow of compressed air, and at the same time blocks the bleed aperture 58. Compressed air will then pass through the conduit 46, the bores 52 to 55, and the manifold 56 in the cap 38 and thence is directly applied to rear face of the rearmost adhesive block 29 to advance the latter along the feed passage 30.

As can be seen most clearly in FIG. 4, and as described in the said co-pending applications, the block 29 is essentially a solid cylindrical member with its rear end (relative to the direction of its advance in normal use) formed with an annular flange 71 which in use forms a resiliently yielding pressure seal with the interior of the passage 30. Thus the rear end of the block and its flange 71 together constitute a piston face for the direct application thereto of compressed air, thus obviating the need to provide a separate mechanical piston.

When the front end of the front adhesive block reaches the front of the PTFE sleeve 35 and beyond, that front end is liquefied. Liquid adhesive then passes, via the tapering portion 20, into the bore 15 of the nozzle unit 11 up to the constriction 22. The pressure of the liquid causes the stem 25 to move to the left (as viewed in FIG. 1) against the biasing force of the spring 23, thereby allowing liquid adhesive to flow past the flat sides 26 of the stem 25 to the discharge orifice 17.

It will be appreciated that the preferred embodiment described herein provides a dispensing gun which is of relatively simple construction, is relatively inexpensive to fabricate and is substantially trouble-free in operation. By suitably controlling the viscosity of the adhesive used, by choosing a heater of appropriate capacity, by controlling the operation of the heater, and by selecting the dimensions of the nozzle bore and the amount of obstruction of flow by the stem, it is possible to meter the outflow of liquid adhesivve at a controlled rate. From a safety viewpoint, the major portion of the gun — and certainly the portion likely to be touched by the operator — will not become too hot in use and separate artificial cooling is unnecessary. Blockages due to resolidifying adhesive are prevented by the location of the heater near the discharge orifice.

At the same time various modifications are possible within the scope of the invention. Thus the heater may be located transversely of the nozzle so as to pass through the bore in the nozzle. The provision of the tapering portion 20 is not essential.

Turning now to FIGS. 5 to 10, a second preferred embodiment of a dispensing gun will now be described. This embodiment contains parts similar to, or functionally equivalent to, parts in the embodiment of FIGS. 1 to 3. These parts have been allotted reference numbers increased by 100.

The dispensing gun according to FIGS. 5 to 10 is accordingly designated by 110 and comprises a nozzle unit 111, a barrel or housing 112, and a piston-grip actuator casing 113. These parts will now be described in detail, but only insofar as they differ from the corresponding parts of the previous embodiment.

The nozzle unit 111 includes a nozzle body 114 which has a portion 120 secured, by means described below, to the barrel 112. The portion 120 is of enlarged cross-section and has an integral annular flange 121 against which bears, on the nozzle tip side, an annular insulating washer 127. The outer surface of the portion 120 tapers inwardly towards its junction with the barrel 112.

The bore 118 for the cartridge heater 119 may be angled for easier insertion of the latter with its wiring.

About half-way along the length of the nozzle unit 111, the bore 115 is terminated by an externally threaded, hollow, cylindrical sleeve 101 which is formed internally with a frusto-conical lip 122 diverging towards the barrel 112. In the sleeve 101 an axially displaceable valve member 125 is loosely mounted. The valve member 125 has a conical tip 102 converging towards the barrel and adapted to cooperate with the lip 122 such that the latter can be completely obturated by the tip 102. As in FIG. 2, the valve member 125 has flat sides 126 along which flow may take place. The lef-hand end of the valve member, as viewed, has a central, cylindrical spigot 128 against which a spring 123 bears to urge the valve member into a normally closed position openable in response to hydraulic pressure of liquefied adhesive. The spring 123 is located inside an externally threaded sleeve 103 the left-hand end of which is formed with an annular face 104 serving as an abutment for the spring 123. The face 104 has a central aperture to permit outflow of adhesive. The exchangeable tip body 116 is screwed to the sleeve 103.

The front end of the barrel 112, i.e. the left-hand, as viewed, is provided with a plurality of parallel, annular cooling fins 131. A radially inwardly directed annular flange 132 engages behing the insulating washer 127 to couple the barrel 112 with the nozzle body 114. This coupling arrangement permits very rapid assembly and dismantling of the barrel and the nozzle unit.

The internal surface of the barrel 112 engages an annular sleeve 135 made of a heat-insulating and low-friction material such as PTFE. The sleeve 135 is made up of two portions **135*a* and 135*b* of respectively smaller and larger outer diameter, the portion 135*a*** being disposed mainly within the finned part of the barrel. The advantages of using a PTFE sleeve have already been described.

The rear or right-hand end 137 of the barrel 112 co-operates with a loading cap 138 in the manner described in more detail below. The barrel 112 is secured to the pistol-grip actuator casing 113 in any suitable manner, e.g. by rivets or bolts, or it may be of one piece therewith.

The casing 113 is hollow and a trigger 141 projects from the front edge thereof. The trigger 141 cooperates with a spring-biased valve rod 142 forming part of a displaceable valve member such as the member 44 described above. The valve member can move across an air conduit 143 to prevent or to permit air flow through the air conduit.

The rear edge of the casing is formed with an opening 145 through which a pipe 146 extends. The pipe 146 communicates at one end with the conduit 143 downstream of the valve and at its other end connects into a bore 147 by way of a junction 148, the bore 147 being formed in a thrust ring 149 bolted to the barrel 112 and communicating with the interior of the feed passage 130 by way of an inlet opening 150.

The ring 149 is formed with an annular groove 158 which is adapted loosely to receive the annular skirt portion 151 of a sealing gasket 152 the shape of which may be best appreciated from FIG. 10. The gasket 152 is made of elastomeric material. The skirt portion 151 has a greater wall thickness than the frusto-conical portion 153 connected to it. The frusto-conical portion 153 is adapted to lie against the loading cap 138. The cap 138 is of domed construction and is hinged by pin 154 to a strip 155 of metal secured to the top of the barrel and incorporating an abutment for the pivotal movement of the cap 138. The pivotal movement of the cap is illustrated in FIG. 5 wherein the chain-dotted lines indicate the cap 138 on its way to the loading position, uncovering the ring 149 and thus the feed passage 130. A yoke 156 is pivotally secured at 157 to the side of the barrel 112 and is movable between the two positions shown in FIG. 5 to engage the cap 138 and to prevent it from being opened, on the one hand, and to disengage from the cap 138 and thus to allow it to be pivotally moved to uncover the feed passage, on the other hand.

When the yoke 156 is engaged with the cap 138, the bridge portion of the yoke acts as a cam to force the cap 138 against the end face of the ring 149, but nevertheless the cap 138 has substantial play — in other words, it covers the end face of the ring 149 only loosely. When, however, the trigger 141 is actuated and the valve member is the actuator casing 113 frees the conduit 143 for flow of compressed air, that flow will reach the feed passage 130 via the inlet 150. The pressure will act not only on a previously loaded adhesive block (such as is shown at 29 in FIG. 4) but also on the frusto-conical portion 153 of the gasket 152, whereby to cause that portion sealingly to lie against the adjacent surface of the loading cap 138. This sealing arrangement of the parts 138, 149, 152, and 158 allows important economies to be made in the fabrication of the dispensing gun, because the tolerances of the individual parts, especially of the cap 138, may be much greater than if, for instance, an O-ring type of seal had been used.

FIG. 5 also shows that the temperature control unit (not shown separately in FIG. 5, but provided as a discrete unit externally of the gun) has a temperature feedback via a thermistor 163 embedded in the nozzle block. The line 161 is connected to the thermistor 163 and the heater 119 by lines 164.

In order to accelerate the liquefaction time of an adhesive block and to reduce the heat input required, the cartridge heater 119 is heat-conductively connected to a heat transfer member 170 which extends at least partly into the path of advance of the block so as to increase the contact or heat transfer area between the heater and the block. FIGS. 8 and 9 show a preferred configuration for the member 170; however, other configurations will readily occur to a man skilled in the art once he appreciated that the task is to increase the heat transfer area.

In FIGS. 8 and 9 the member 170 is in the form of a ring of six spaced-apart, angled, axially projecting blades 175, somewhat like a turbine disc with its blades. The blades 175 extend axially and thus greatly increase the heat transfer area, while the fact that they are angled also increases the path of the adhesive, thereby further improving the heat transfer conditions and also imparting swirl to the liquid adhesive.

The operation of the gun described so far is as follows. It is assumed that the heater cartridge has been connected via an external control box which includes the temperature control unit to an electrical power source, and the conduit 143 has been connected to a source of compressed air.

First, the cap 138 is pivoted to its loading position, and two adhesive blocks or cartridges 29 are introduced into the feed passage 130. The cap 138 is then loosely re-closed with the aid of the yoke 156. The gun 110 is now ready for use.

When the operator presses the trigger 141 against the biasing force of the spring, the valve member moves across the air conduit 143 to free the latter for the flow of compressed air. Compressed air will then pass through the air inlet opening 150 into the feed passage 130 and cause the gasket 152 to be deformed and to seal the cap 138. The compressed air is directly applied to rear face of the rearmost adhesive block 29 to advance the latter along the feed passage 130, the block 29 being, of course, in sealing, yet resiliently yielding engagement with the interior of the passage 130. Thus the rear end of the block 29 and its sealing flange 71 together constitute a piston face for the direct application thereto of compressed air, thus obviating the need to provide a separate mechanical piston, with the attendant advantages already described.

Meanwhile, the heater cartridge has been energised. When the front end of the front adhesive block is liquefied, continued pneumatic pressure on the solid part of the rearmost block will cause the latter to act as a piston on the liquefied part. As a result, liquid adhesive passes into the bore 115 of the nozzle unit 111 up to the lip 122. The hydraulic pressure of the liquid causes the valve 125 to move to the left (as viewed in FIG. 5) against the biasing force of the spring 123, thereby allowing liquid adhesive to flow past the flat sides 126 of the valve 125 to the discharge orifice 117.

A vent opening or aperture 180 is provided in the sleeve 135. As described, the opening 180 provides an aural warning of the need to reload the gun.

The elimination of the piston leads to a further and perhaps less immediately evident advantage. When no adhesive block is loaded into the feed passage, there is no physical obstruction whatsoever to air flow across the full length and cross-section of the feed passage 130 and of the bore 115 from the air inlet opening 150 to the valve stem 125 — in contrast, of course, to known dispensing guns with a mechanical piston between the air inlet and the corresponding valve. This enables one to purge the gun by simply holding it pointed downwardly, pressing the trigger and causing the air pressure to open the valve stem 125, whereby to expel any residual adhesive from the passage 130 or the bore 115 through the discharge orifice 117.

The fact that the valve 25 or 125 in the nozzle operates solely by the hydraulic pressure of liquefied adhesive has a further advantage over prior art solutions where the corresponding valve is mechanically linked to a trigger. Should any adhesive resolidify around the valve after an extended period of non-use of the gun, pulling the trigger in the prior art guns would result in breakage of the mechanical link. In contrast, in this invention, even in the unlikely event of solid adhesive being around the valve at a "cold" start, no damage to the valve can occur. Furthermore, for this reason in certain prior art guns active steps had to be taken to ensure correct sequential switching-on of the electric power and then the air supply. Similar steps had to be taken at switching-off, to provide cooling air. In this invention, by contrast, no such precautions are necessary at switching-on or switching-off.

It will be appreciated that the preferred embodiment described herein provides a dispensing gun with the same advantages as have already been mentioned above, together with the additional advantages due to the provision of the vent opening, of the loose sealing gasket, of the improved assembly of the sub-units of the gun and of the simplified air flow control.

Should it be necessary for any reason to dismantle the gun, such an operation could scarcely be simpler. The loading cap is lifted and the thrust ring is unscrewed; the electric wires are removed; whereafter the sleeve 135 can be slid out. Then the whole nozzle unit can be removed through the housing.

Although in the foregoing the feed passage 30 or 130 has been described as accommodating two blocks, it is envisaged that it will in fact accommodate 1¾ blocks.

I claim as my invention:

1. Dispensing apparatus for dispensing adhesive material comprising:

a. a housing;

b. a feed passage in the housing having adhesive in the form of at least one normally substantially solid but heat-liquefiable block which has seal-forming means to form a fluid-tight yet yieldable seal with the wall of the feed passage, c. nozzle means for discharging liquefied adhesive and communicating with the forward end of the feed passage, d. actuating means adapted normally to prevent any flow of pressurized fluid from a source of such fluid to the feed passage and adapted on actuation to permit such flow;

e. permanently open fluid flow ducting extending from said actuating means to the feed passage so that in use pressurized fluid flows directly to the rear of a said block in the feed passage without the intermediation of any mechanical means to propel the said block axially along the feed passage towards the discharge opening; and f. heating means located adjacent the forward end of the feed passage for heating and progressively liquefying a said block of adhesive from its leading end, the solid portion of the said block serving, in use, as a piston for the liquefied portion thereof with said seal-forming means preventing pressurized fluid from coming into contact with said liquefied portion.

2. Dispensing apparatus according to claim 1 wherein the nozzle means is attached to said housing and defines said discharge opening, and the heating means is accommodated wholly in the nozzle means.

3. Dispensing apparatus according to claim 2 wherein an internal bore is defined in the nozzle means for communicating the feed passage with the discharge opening, there being a dispensing valve in said bore operable solely by hydraulic pressure of liquefied adhesive for permitting and preventing flow thereof to the discharge opening.

4. Dispensing apparatus according to claim 1 wherein a heat-conductive member is connected to the heating means and extends partly into and across the path of the block of adhesive to increase the rate of transfer of heat thereto.

5. Dispensing apparatus according to claim 4 wherein said heat-conductive member is in the form of a ring of angled turbine blade-like projections, made of metal.

6. Dispensing apparatus according to claim 2 wherein the nozzle means includes a readily removable and replaceable nozzle tip body in which said discharge opening is formed, the opening being of predetermined dimensions to assist in controlling the flow rate of molten adhesive, the said tip body constituting a member of a set of nozzle tip bodies of varying dimensions.

7. Dispensing apparatus according to claim 3 wherein the nozzle means is of reduced outer diameter relative to that of the housing and the internal cross-section of the bore is smaller than that of the feed passage.

8. Dispensing apparatus according to claim 1 wherein a load opening is defined in the feed passage through which said blocks(s) may be loaded into the feed passage, a cap displaceable to cover and uncover the load opening, a latch for securing the cap in its position covering the load opening, a deformable sealing member, a recess defined between adjacent surfaces of the cap and the edges of the said opening, the recess receiving said sealing member mounted as a loose fit, a fluid inlet opening defined in the feed passage forwardly of the load opening, the arrangement being such that when the cap is closed and latched, introduction of pressurized fluid into the feed passage deforms the sealing member to make a fluid-tight seal between the cap and the said edges.

9. Dispensing apparatus according to claim 1 wherein said ducting includes a conduit for conveying pressurized fluid to one end of the feed passage, and a closure member for said one end which incorporates a part of said conduit and which is movable between a first position in which it uncovers said one end to permit a said block to be loaded into the feed passage and a second position in which it closes said one end and establishes communication between said conduit and the feed passage for the direct application of pressurized fluid to the block.

10. A dispensing apparatus according to claim 1 wherein at least the forward end portion of the feed passage is defined by the interior of an elongated sleeve of heat-insulating and low-friction material.

11. Dispensing apparatus according to claim 1 wherein a vent opening communicating with the atmosphere is defined in the wall of the feed passage such that where the feed passage can accommodate more than one block and in use the seal-forming means of the rearmost block has been consumed, further application of pressurized fluid will result in such fluid rushing through the vent opening to provide an operator with an aural warning.

12. Dispensing apparatus according to claim 1 wherein a valve member is included in said actuating means, and means are provided for biasing the valve member for controlling flow of pressurized fluid into a flow-preventing setting, there being a trigger device for displacing the valve member to a flow-permitting setting.

13. Dispensing apparatus according to claim 9 further including a pistol-grip casing connected to the said housing, the actuator means including a trigger mounted in the pistol-grip casing, a displaceable, substantially part-spherical member in the said casing, a shank connecting the said member to the closure member of the feed passage, said conduit passing through the interior of the part-spherical member, the shank and the closure member.

14. Dispensing apparatus according to claim 3 wherein the heating means is a cartridge heater located in the nozzle member and extending parallel with the bore without overlapping with the feed passage at all.

15. A method of dispensing a solid adhesive block made of hot melting material in a pistonless adhesive dispenser which includes a feed passage the forward end of which has a dispensing outlet, comprising the steps of:

forming on the adhesive block at least one flange dimensioned for resiliently yielding but fluid-tight sealing engagement with the said feed passage;

inserting the said block in the feed passage;

supplying pressurized fluid to the rear end of the adhesive block to advance the adhesive block along the feed passage to the dispensing outlet with the rear end of the adhesive block and said at least one flange acting together as a piston face directly to receive pressurized fluid; and melting the forward end of the block as it advances along the feed passage, whereby to dispense liquid adhesive from said outlet.

16. Dispensing apparatus for dispensing adhesive material comprising:

a. a housing;

b. a feed passage in the housing adapted to receive adhesive in the form of at least one normally substantially solid but heat-liquefiable block which has seal-forming means adapted to form a fluid-tight yet yieldable seal with the feed passage, c. a discharge opening for liquefied adhesive communicating with the feed passage, d. coupling means for enabling the feed passage to be connected to a source of pressurized fluid so that in use fluid pressure is applied directly to a said block in the feed passage without the intermediation of a mechanical piston to advance the said block axially along the feed passage towards the discharge opening;

e. heating means for heating and progressively liquefying a said block of adhesive from its leading end, the solid portion of the said block serving, in use, as a piston for the liquefied portion thereof with said seal-forming means preventing pressurized fluid from coming into contact with said liquefied portion, f. actuating means for controlling the flow of pressurized fluid from said source via the coupling means to the feed passage, and g. a vent opening communicating with the atmosphere and defined in the wall of the feed passage such that where in use the seal-forming means of the rearmost of said at least one block has been liquefied by heat, further application of heat will result in such fluid rushing through the vent opening to provide an operator with an aural warning and substantially to prevent said fluid from passing through the discharge opening.

17. Dispensing apparatus for dispensing adhesive material comprising:

a. a housing;

b. a feed passage in the housing adapted to receive adhesive in the form of at least one normally substantially solid but heat-liquefiable block which has seal-forming means to form a fluid-tight yet yieldable seal with the wall of the feed passage, c. nozzle means for discharging liquefied adhesive and communicating with the forward end of the feed passage, d. actuating means adapted normally to prevent any flow of pressurized fluid from a source of such fluid to the feed passage and adapted on actuation to permit such flow;

e. permanently open fluid flow ducting extending from said actuating means to the feed passage so that in use pressurized fluid flows directly to the rear of a said block in the feed passage without the intermediation of any mechanical means to propel the said block axially along the feed passage towards the discharge opening;

f. heating means located adjacent the forward end of the feed passage for heating and progressively liquefying a said block of adhesive from its leading end, the solid portion of the said block serving, in use, as a piston for the liquefied portion thereof with said seal-forming means preventing pressurized fluid from coming into contact with said liquefied portion; and g. a load opening in the feed passage through which said block may be loaded into the feed passage, a cap displaceable to cover and uncover the load opening, a latch for securing the cap in its position covering the load opening, a deformable sealing member, a recess defined between adjacent surfaces of the cap and the edges of the said opening, the recess receiving said sealing member mounted as a loose fit, a fluid inlet opening defined in the feed passage forwardly of the load opening, the arrangement being such that when the cap is closed and latched, introduction of pressurized fluid into the feed passage deforms the sealing member to make a fluid-tight seal between the cap and the said edges.

* * * * *